US009996023B2

(12) United States Patent
Seto

(10) Patent No.: US 9,996,023 B2
(45) Date of Patent: Jun. 12, 2018

(54) IMAGE FORMING APPARATUS TO WHICH UNLOCKING OPERATION FOR UNLOCKING TONER CONTAINER LOCKED TO APPARATUS MAIN BODY IS INPUT

(71) Applicant: KYOCERA Document Solutions Inc., Osaka (JP)

(72) Inventor: Akifumi Seto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/284,844

(22) Filed: Oct. 4, 2016

(65) Prior Publication Data

US 2017/0102637 A1 Apr. 13, 2017

(30) Foreign Application Priority Data

Oct. 9, 2015 (JP) ..... 2015-201015

(51) Int. Cl.
*G03G 15/08* (2006.01)
*G03G 21/16* (2006.01)

(52) U.S. Cl.
CPC ..... *G03G 15/0831* (2013.01); *G03G 15/0856* (2013.01); *G03G 21/1676* (2013.01); *G03G 2221/1654* (2013.01)

(58) Field of Classification Search
CPC ..... G03G 15/0831; G03G 15/0856; G03G 21/1676; G03G 2221/1654
USPC ..... 399/61
See application file for complete search history.

(56) References Cited

U.S. PATENT DOCUMENTS 8,437,648 B2 5/2013 Tachibana
8,509,651 B2 * 8/2013 Tsukijima ..... G03G 15/0868 399/111
2010/0329704 A1 * 12/2010 Tachibana ..... G03G 15/553 399/27

FOREIGN PATENT DOCUMENTS

JP 2005-091462 A 4/2005
JP 2011-008142 A 1/2011
JP 2011-245729 A 12/2011

OTHER PUBLICATIONS

An Office Action; "Notification of Reasons for Refusal," mailed by the Japanese Patent Office dated Mar. 27, 2018, which corresponds to Japanese Patent Application No. 2015-201015 and is related to U.S. Appl. No. 15/284,844; with English language translation.

* cited by examiner

*Primary Examiner* — Billy Lactaoen
(74) *Attorney, Agent, or Firm* — Studebaker & Brackett PC

(57) ABSTRACT

An image forming apparatus includes a casing, a toner container, a latch mechanism, a toner sensor, a determination section, and a locking control section. The latch mechanism locks the toner container in the casing. When the determination section determines that a detection result of the toner sensor is greater than an amount range of remaining toner in a nearly empty state, the locking control section controls the latch mechanism to lock the toner container in the casing. When the determination section determines that a detection result of the toner sensor falls in the amount range of remaining toner in the nearly empty state, the locking control section controls the latch mechanism to unlock the toner container in the apparatus main body in response to an unlocking operation input through an operation input section.

5 Claims, 8 Drawing Sheets

IMAGE FORMING APPARATUS TO WHICH UNLOCKING OPERATION FOR UNLOCKING TONER CONTAINER LOCKED TO APPARATUS MAIN BODY IS INPUT

INCORPORATION BY REFERENCE

The present application claims priority under 35 U.S.C. § 119 to Japanese Patent Application No. 2015-201015, filed on Oct. 9, 2015. The contents of this application are incorporated herein by reference in their entirety.

BACKGROUND

The present disclosure relates to an image forming apparatus.

An image forming apparatus that prints a toner image on paper includes a toner container. The toner container accommodates toner. When the amount of toner remaining in the toner container is an amount of toner in an empty state (i.e., when the toner container is empty of toner) in the image forming apparatus, it is necessary to replace the toner container by a new toner container. As such, the toner container is attached to an apparatus main body of the image forming apparatus in a detachable manner.

An image forming apparatus such as above includes a latch mechanism. The latch mechanism is provided for preventing replacement of the toner container in a situation in which much toner remains in the toner container.

The latch mechanism locks the toner container in the apparatus main body when the amount of toner remaining in the toner container is greater than the empty toner amount. In the above configuration, the toner container is prevented from being detached from the apparatus main body. When the amount of toner remaining in the toner container becomes the amount of tone in the empty state, the latch mechanism unlocks the toner container. Through the above, the toner container becomes replaceable.

SUMMARY

An image forming apparatus according to the present disclosure includes an apparatus main body, a toner container, a latch mechanism, a toner sensor, a determination section, an operation input section, and a locking control section. The toner container is attached to the apparatus main body in a detachable manner. The latch mechanism locks the toner container in the apparatus main body to prevent the toner container from being detached from the apparatus main body. The toner sensor detects an amount of toner remaining in the toner container. The determination section determines whether or not a detection result of the toner sensor falls in an amount range of remaining toner in a near empty state. The operation input section receives an unlocking operation for unlocking the toner container in the apparatus main body locked by the latch mechanism. The locking control section controls the latch mechanism. When the determination section determines that a detection result of the toner sensor is greater than an amount range of remaining toner in a nearly empty state, the locking control section controls the latch mechanism to lock the toner container in the apparatus main body. When the determination section determines that a detection result of the toner sensor falls in the amount range of remaining toner in the nearly empty state, the locking control section controls the latch mechanism to unlock the toner container in the apparatus main body in response to the unlocking operation input through the operation input section.

DETAILED DESCRIPTION

Figure 1:
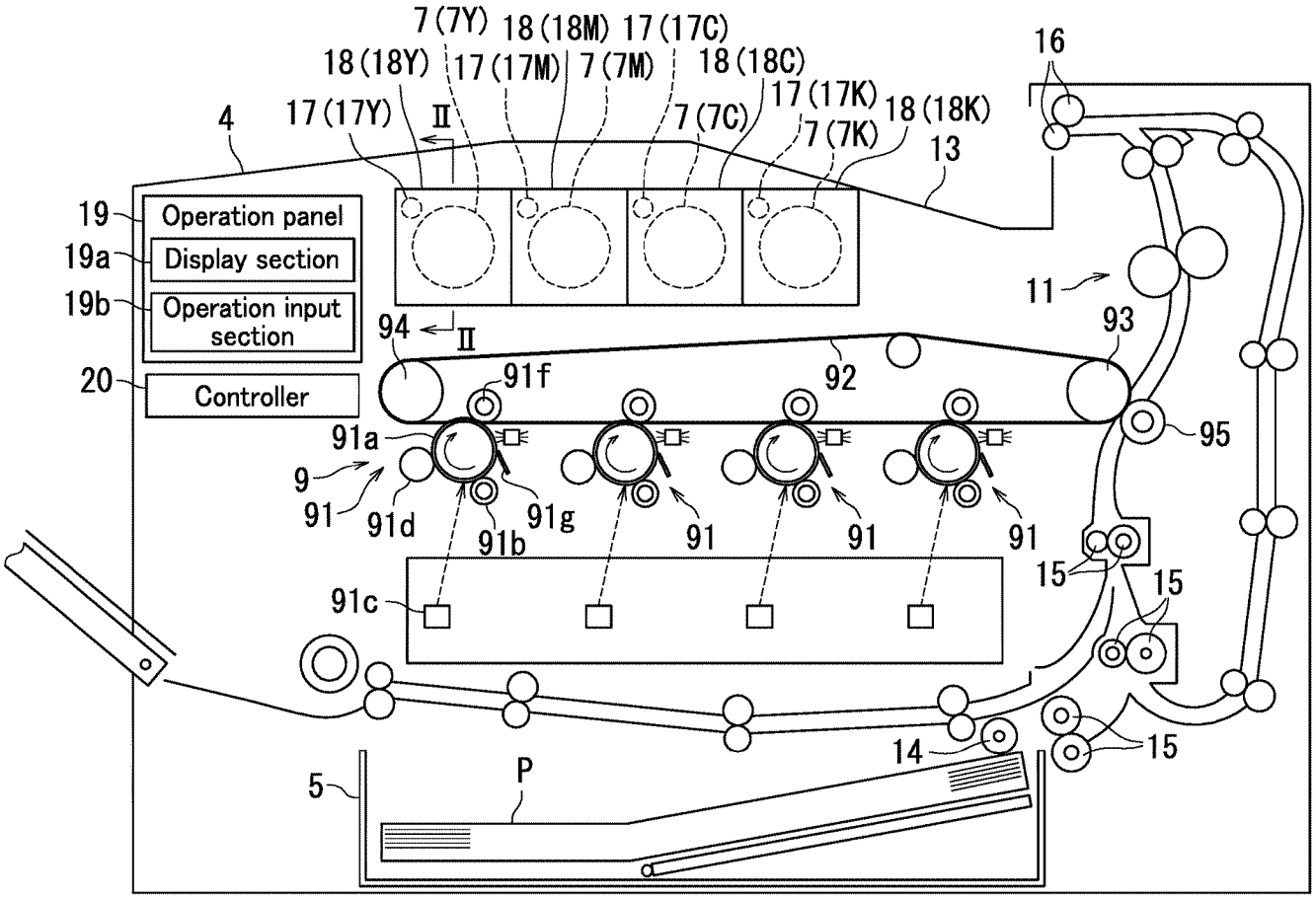
FIG. 1 illustrates a configuration of an image forming apparatus according to an embodiment.

The following explains an embodiment of the present disclosure with reference to the drawings. Elements in the drawings that are the same or equivalent are marked by the same reference signs. Furthermore, explanation of such elements is not repeated.

The following first explains an image forming apparatus according to the present embodiment with reference to FIG. 1. FIG. 1 illustrates a configuration of the image forming apparatus according to the present embodiment.

An image forming apparatus 1 according to the present embodiment forms an image on paper using toner. The image forming apparatus 1 includes a casing 4 (apparatus main body), a paper feed cassette 5, a plurality of toner containers 7, an image forming section 9, a fixing section 11, an exit tray 13, a paper feed roller 14, plural pairs of conveyance rollers 15, a pair of paper ejection rollers 16, a plurality of toner sensors 17, a plurality of latch mechanisms 18, an operation panel 19, and a controller 20.

The paper feed cassette 5, the toner containers 7, the image forming section 9, the fixing section 11, the paper feed roller 14, the pairs of conveyance rollers 15, the pair of paper ejection rollers 16, the toner sensors 17, the latch mechanisms 18, and the controller 20 are disposed in the casing 4. The operation panel 19 is disposed on the outer surface of the casing 4, for example. The exit tray 13 is disposed on the upper surface of the casing 4, for example.

The paper feed cassette 5 feeds a sheet P to the image forming section 9. A plurality of sheets P are stacked in the paper feed cassette 5. The sheets P stacked in the paper feed cassette 5 are fed by the paper feed roller 14 one at a time. The sheet P fed by the paper feed roller 14 is conveyed to the image forming section 9 by the pairs of conveyance rollers 15.

The toner containers 7 each accommodate a corresponding one of toners in plural colors (for example, yellow (Y), magenta (M), cyan (C), and black (K)) and each supply a corresponding one of the accommodated toners to the image forming section 9. Each of the toner containers 7 is attached to the casing 4 in a detachable manner. Hereinafter, the toner containers 7 each accommodating a corresponding one of the toners in respective colors of Y, M, C, and K are also referred to as toner containers 7Y, 7M, 7C, and 7K.

The toner sensors 17 each correspond to one of the toner containers 7. The toner sensors 17 each detect the amount of toner remaining in the corresponding toner container 7. The toner sensors 17 are for example magnetic permeability sensors and each detect the amount of toner remaining in the corresponding toner container 7 by detecting the magnetic permeability of the toner in the toner container 7. Hereinafter, the toner sensors 17 corresponding to the respective toner containers 7Y, 7M, 7C, and 7K may be referred also to toner sensors 17Y, 17M, 17C, and 17K.

The respective toner sensors 17 in the present embodiment are disposed in the casing 4 but may each be disposed at a corresponding one of the toner containers 7.

The latch mechanisms 18 each are provided for a corresponding one of the toner containers 7. The latch mechanisms 18 lock the respective toner containers 7 in the casing 4 in an unlockable manner. Locking a toner container 7 prevents the toner container 7 from being detached from the casing 4. Hereinafter, the latch mechanisms 18 each corresponding to one of the toner containers 7Y, 7M, 7C, and 8K may be referred also to latch mechanisms 18Y, 18M, 18C, and 18K. A configuration of each latch mechanism 18 will be described later in detail with reference to FIG. 2.

The image forming section 9 forms an image represented by image data on the sheet P using toners. The image forming section 9 includes a plurality of image forming units 91, an intermediate transfer belt 92, a drive roller 93, a driven roller 94, and a secondary transfer roller 95.

The image forming units 91 each correspond to one of the toner containers 7. Toners are supplied to the respective image forming units 91 from the corresponding toner containers 7. The image forming units 91 each form a toner image in a corresponding one of the colors on the surface of the intermediate transfer belt 92 based on the image data. For example, the toner container 7Y is provided for an image forming unit 91 that forms a toner image using the toner in the yellow (Y) color among the image forming units 91. Similarly, the toner container 7M is provided for an image forming unit 91 that forms a toner image using a magenta (M) toner. The toner container 7C is provided for an image forming unit 91 that forms a toner image using the toner in the cyan (C) color. The toner container 7K is provided for an image forming unit 91 that forms a toner image using the toner in the block (K) color. The toner images in the respective colors are superimposed on the intermediate transfer belt 92. Through the above, a full toner image is formed on the surface of the intermediate transfer belt 92.

The image forming units 91 each include a photosensitive drum 91*a*, a charger 91*b*, an exposure device 91*c*, a developing device 91*d*, a primary transfer roller 91*f*, and a cleaner 91*g*.

The photosensitive drum 91*a* includes a photosensitive layer on the surface thereof. The charger 91*b* uniformly charges the surface of the photosensitive drum 91*a* to a specific potential. The exposure device 91*c* irradiates the surface of the photosensitive drum 91*a*, which has been charged, with laser light. Through the above, an electrostatic latent image corresponding to an image represented by the image data is formed on the surface of the photosensitive drum 91*a*. The developing device 91*d* develops the electrostatic latent image on the surface of the photosensitive drum 91*a* into a toner image using a toner.

The primary transfer roller 91*f* transfers the toner image on the surface of the photosensitive drum 91*a* to the surface of the intermediate transfer belt 92. The primary transfer roller 91*f* is in press contact with the photosensitive drum 91*a* with the intermediate transfer belt 92 therebetween. A press contact region formed by the above press contact serves as a primary transfer nip region. Primary transfer voltage is applied to the primary transfer roller 91*f*. As a result, the toner image on the surface of the photosensitive drum 91*a* is transferred to the intermediate transfer belt 92 by electrostatic attraction of the primary transfer roller 91*f* when passing through the primary transfer nip region. The cleaner 91*g* removes residual toner from the surface of the photosensitive drum 91*a* after transfer.

The intermediate transfer belt 92 conveys the full color toner image on the surface thereof to the secondary transfer roller 95. The intermediate transfer belt 92 is an endless belt and is supported by being wound around the drive roller 93 and the driven roller 94. The intermediate transfer belt 92 is circulated by being rotationally driven by the drive roller 93. Circulation of the intermediate transfer belt 92 result in conveyance of the full color toner image on the surface of the intermediate transfer belt 92 to the secondary transfer roller 95.

The secondary transfer roller 95 transfers the full color toner image on the surface of the intermediate transfer belt 92 to the sheet P. The secondary transfer roller 95 is in press contact with the drive roller 93 with the intermediate transfer belt 92 therebetween. A press contact region formed by the above press contact serves as a secondary transfer nip region. Secondary transfer voltage is applied to the secondary transfer roller 95. As a result, when the full color toner image on the surfaces of the intermediate transfer belt 92 passes through the secondary nip region together with the sheet P, the full color toner image is transferred to the sheet P by electrostatic attraction of the secondary transfer roller 95.

The fixing section 11 fixes the full color toner image transferred to the sheet P by applying heat and pressure to the sheet P. Through the above processes, an image is formed on the sheet P. The sheet P on which the image has been formed is ejected onto the exit tray 13 by the pair of paper ejection rollers 16.

The operation panel 19 receives input of various operations for operating the image forming apparatus 1. The various operations include an unlocking operation. The unlocking operation is an operation for unlocking one of the toner containers 7 locked by the respective latch mechanisms 18.

The operation panel 19 is for example a touch panel and includes a display section 19*a* and an operation input section 19*b*.

The display section 19*a* is for example a liquid crystal display device and displays an operation input screen. The operation input screen is a screen for receiving input of various operations. The operation input section 19*b* is for example a touch sensor and detects a touch point on the display section 19*a*. The touch point is a point where a user touches a screen of the display section 19*a*. In the above configuration, an operation is input by a user touching the operation input screen displayed on the display section 19*a*.

The controller 20 controls respective elements (the toner containers 7, the image forming section 9, the fixing section 11, the paper feed roller 14, the pairs of conveyance rollers 15, the pair of paper ejection rollers 16, and the operation panel 19) of the image forming apparatus 1. A configuration of the controller will be described later in detail with reference to FIG. 3, and following describes a main function of the controller 20.

In a situation in which a detection result of any of the toner sensors 17 is greater than an amount range of remaining toner in a nearly empty state, the controller 20 controls the latch mechanisms 18 such that a latch mechanism 18 corresponding to the toner container 7 locks the toner container 7 in the casing 4.

In the above configuration, in a situation in which the amount of toner remaining in any of the toner containers 7 is greater than the amount range of remaining toner in the nearly empty state (for example, in a situation in which much toner remains), a latch mechanism 18 corresponding to the toner container 7 locks the toner container 7 in the casing 4. As a result, the toner container 7 is not allowed to be replaced by a new toner container.

Note that the nearly empty state is a state in which the amount of toner remaining in a toner container 7 falls in a range from no greater than a specific amount of remaining toner to greater than an amount of toner in an empty state. The specific amount of remaining toner is an amount approximate to the amount of toner in the empty state and can be set optionally by a manufacturer of the image forming apparatus 1. The empty state is a state in which a toner container 7 is empty of toner. The specific amount of remaining toner herein is indicated as an upper limit value NE. That is, the upper limit value NE indicates an upper limit of the amount range of remaining toner in the nearly empty state. The upper limit value NE will be described later in detail with reference to FIGS. 7A to 7F.

By contrast, in a situation in which a detection result of at least one of the toner sensors 17 falls in the amount range of remaining toner in the nearly empty state, the controller 20 controls the latch mechanisms 18 such that a latch mechanism 18 corresponding to the toner sensor 17 unlocks the toner container 7 in response to an unlocking operation input through the operation panel 19.

In the above configuration, a toner container 7 locked by a corresponding latch mechanism 18 can be unlocked through user inputting the unlocking operation through the operation panel 19 in a situation in which the amount of toner remaining in the toner container 7 falls in the amount range of remaining toner in the nearly empty state. As a result, the toner container 7 can be replaced by a new toner container as necessary.

As described as above, replacement of a toner container 7 in which much toner remains can be prevented and a toner container 7 the amount of remaining toner in which falls in the amount range of remaining toner in the nearly empty state can be replaced as necessary in the image forming apparatus 1 according to the present embodiment.

Figure 2:
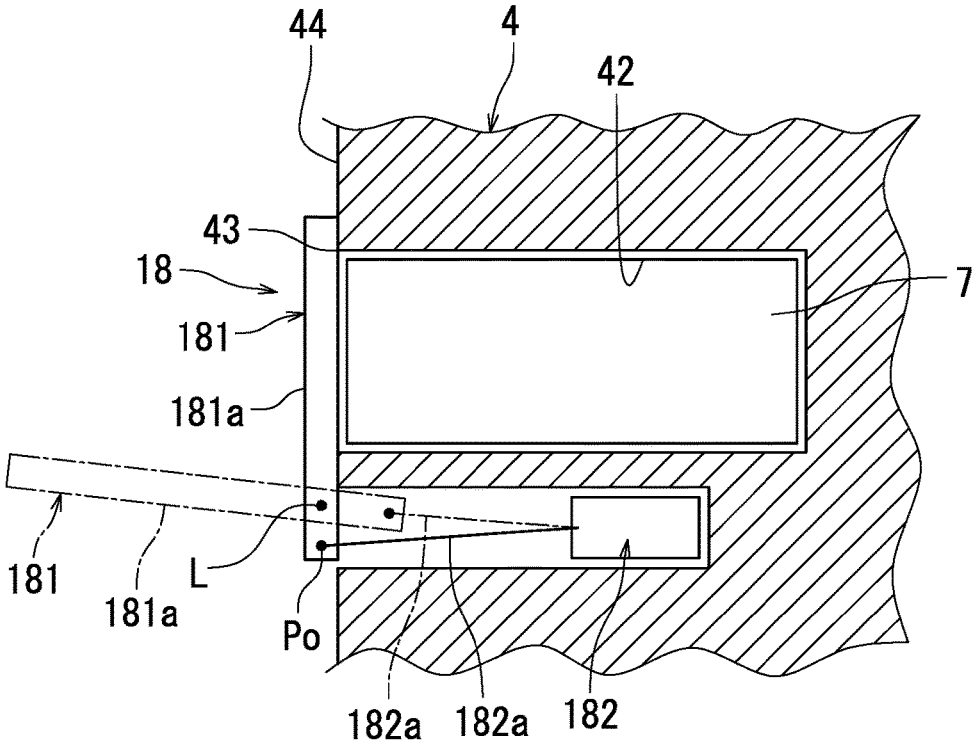
FIG. 2 is a cross sectional view taken along the line II-II in FIG. 1.

A mechanism of each latch mechanism 18 will be described with reference to FIG. 2. FIG. 2 is a cross sectional view taken along the line II-II I FIG. 1.

The casing 4 has accommodation recesses 42. The accommodation recesses 42 each are a space in which a corresponding one of the toner containers 7 is accommodated. Each accommodation recess 42 is located in a side surface portion 44 of the casing 4. The accommodation recess 42 has an opening 43. The opening 43 is an open surface of the accommodation recess 42 into and from which the toner container 7 is inserted and pulled out. The opening 43 is aligned with the side surface portion 44. The toner container 7 is accommodated in the accommodation recess 42 from the opening 43. As a result, the toner container 7 is attached to the casing 4.

The latch mechanisms 18 each include a latching cover 181 and a drive section 182.

The latching cover 181 opens and closes the opening 43 of the accommodation recess 42. The latching cover 181 has for example a flat rectangular plate shape. The latching cover 181 is supported on the casing 4 pivotally about a pivot axis line L. The pivot axis line L is for example located at a lower end part of the latching cover 181 and extends in a left-right direction of a main surface 181*a* of the latching cover 181 (i.e., a direction perpendicular to the drawing surface of FIG. 2). The left-right direction of the main surface 181*a* herein is perpendicular to a vertical direction. The pivot axis line L is located lower than the opening 43, for example.

The drive section 182 pivots the latching cover 181 about the pivot axis line L. The drive section 182 is located for example below the accommodation recess 42. The drive section 182 includes a drive bar 182*a*. The drive bar 182*a* has a tip end connected to the latching cover 181 at a joint point Po of the latching cover 181. The joint point Po is located lower than the pivot axis line L in the latching cover 181.

The drive section 182 pivots the latching cover 181 in a closing direction by pushing the drive bar 182*a* away from the drive section 182. As a result, the latching cover 181 locks the toner container 7 placed in the accommodation recess 42 in the casing 4 by closing the opening 32. By contrast, the drive section 182 pivots the latching cover 181 in an opening direction by pulling the drive bar 182*a* toward the drive section 182. As a result, the latching cover 181 unlocks the toner container 7 placed in the accommodation recess 42 by opening the opening 32.

Figure 3:
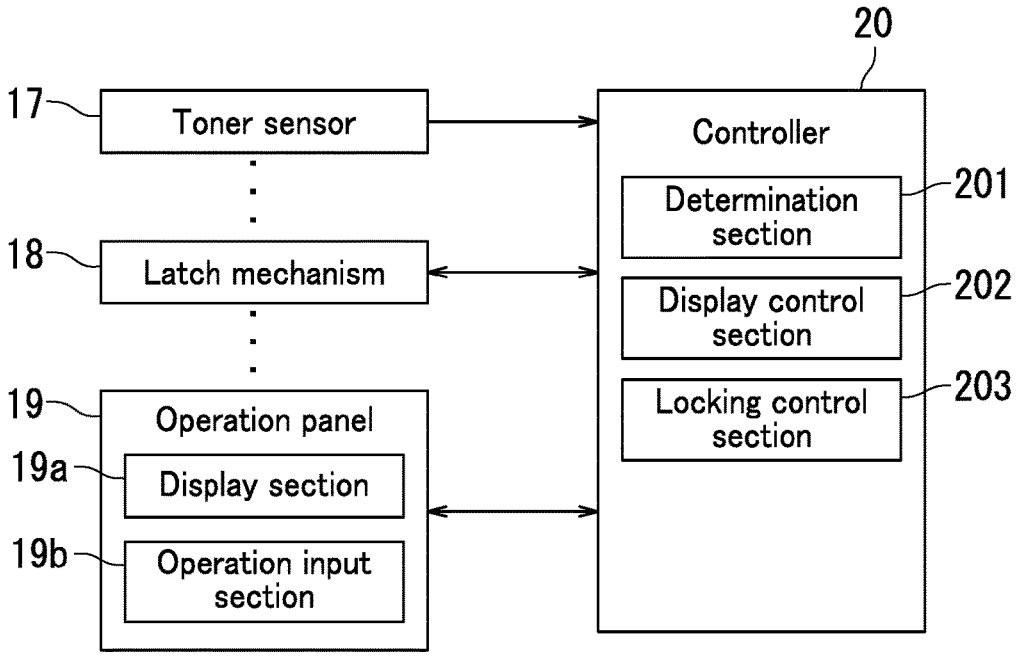
FIG. 3 illustrates a configuration of a controller according to the embodiment.

The following explains a configuration of the controller 20 with reference to FIG. 3. FIG. 3 illustrates an example of the configuration of the controller 20.

The controller 20 includes a determination section 201, a display control section 202, and a locking control section 203.

The determination section 201 determines for each of the toner sensors 17 whether or not a detection result of the toner sensor 17 is greater than the amount range of remaining toner in the nearly empty state.

The display control section 202 controls the display section 19*a* for display. When the determination section 201 determines that a detection result of at least one of the toner sensors 17 falls in the amount range of remaining toner in the nearly empty state, the display control section 202 causes the display section 19*a* to display an unlocking operation input screen. The unlocking operation input screen is a screen for receiving input of the unlocking operation for unlocking a toner container 7 locked by a corresponding latch mechanism 18.

In the above configuration, a toner container 7 locked by a corresponding latch mechanism 18 can be unlocked by user input of the unlocking operation through the unlocking operation input screen in a situation in which the toner container 7 is in the nearly empty state. Examples of the operation input screen will be described later in detail with reference to FIGS. 4-6.

By contrast, when the determination section 201 determines that a detection result of at least one of the toner sensors 17 is greater than the amount range of remaining toner in the nearly empty state, the display control section 202 causes the display section 19*a* not to display the unlocking operation input screen. The unlocking operation input screen is a screen for receiving input of the unlocking operation for unlocking a toner container 7 locked by a corresponding latch mechanism 18.

In the above configuration, in a situation in which the amount of toner remaining in at least one of the toner containers 7 is greater than the amount range of remaining toner in the nearly empty state, the unlocking operation input screen for unlocking the toner container 7 locked by the corresponding latch mechanism 18 is not displayed. Therefore, the toner container 7 locked by the corresponding latch mechanism 18 cannot not be unlocked in a situation in which the amount of toner remaining in the toner container 7 is greater than the amount range of remaining toner in the nearly empty state.

The locking control section 203 controls the respective latch mechanisms 18. Specifically, the locking control section 203 controls the latch mechanisms 18 such that when the determination section 201 determines that a detection result of at least one of the toner sensors 17 is greater than the amount range of remaining toner in the nearly empty state, a latch mechanism 18 corresponding to the toner sensor 17 locks the toner container 7 in the casing 4.

Furthermore, in a situation in which the determination section 201 determines that a detection result of at least one of the toner sensors 17 falls in the amount range of remaining toner in the nearly empty state, the locking control section 203 controls the latch mechanisms 18 such that a corresponding latch mechanism 18 unlocks the toner container 7 upon the unlocking operation being input through the unlocking operation input screen displayed on the display section 19*a*.

By contrast, upon the unlocking operation being not input through the unlocking operation input screen in the above situation, the locking control section 203 controls the corresponding latch mechanism 18 to lock the toner container 7.

Figure 4:
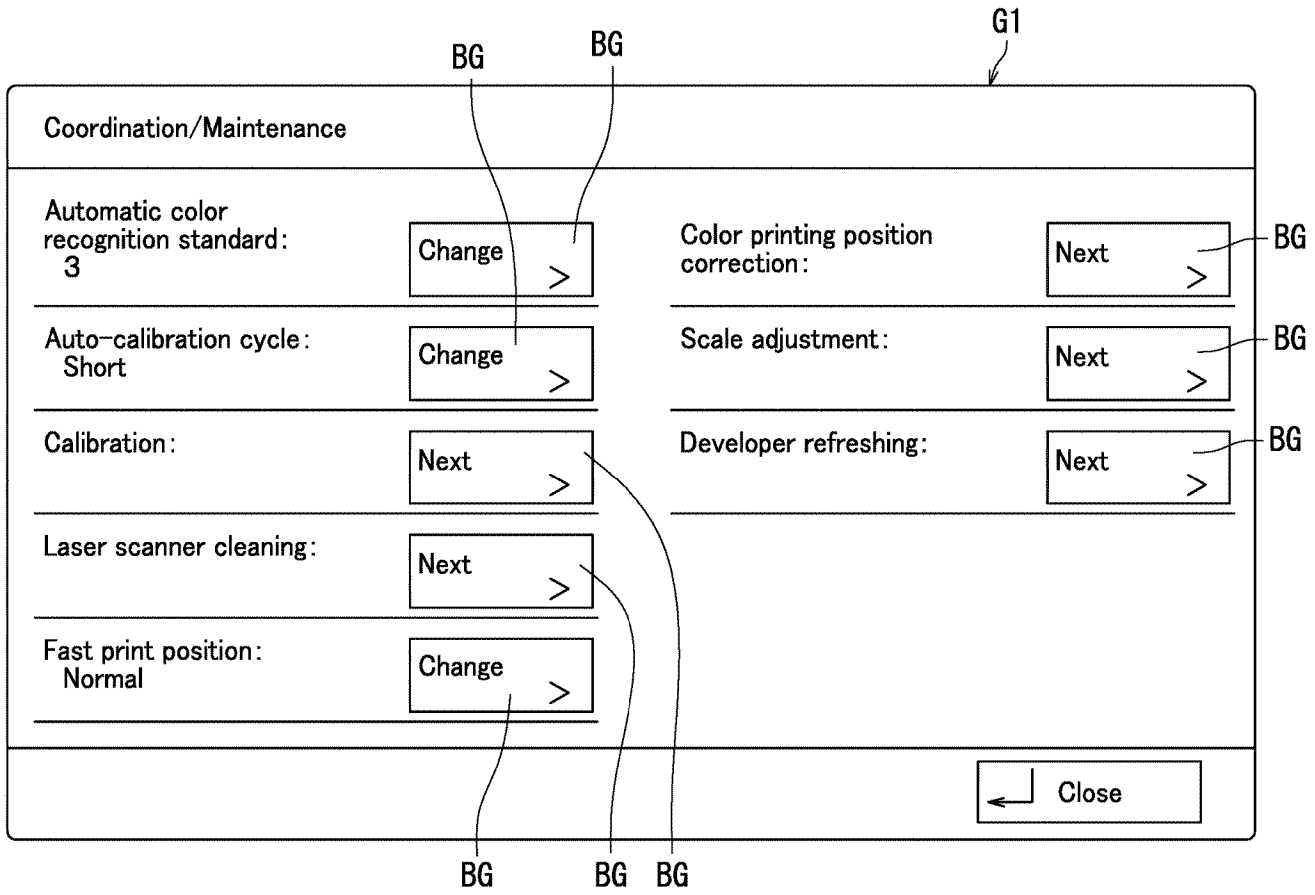
FIG. 4 illustrates an example of an operation input screen.
Figure 5:
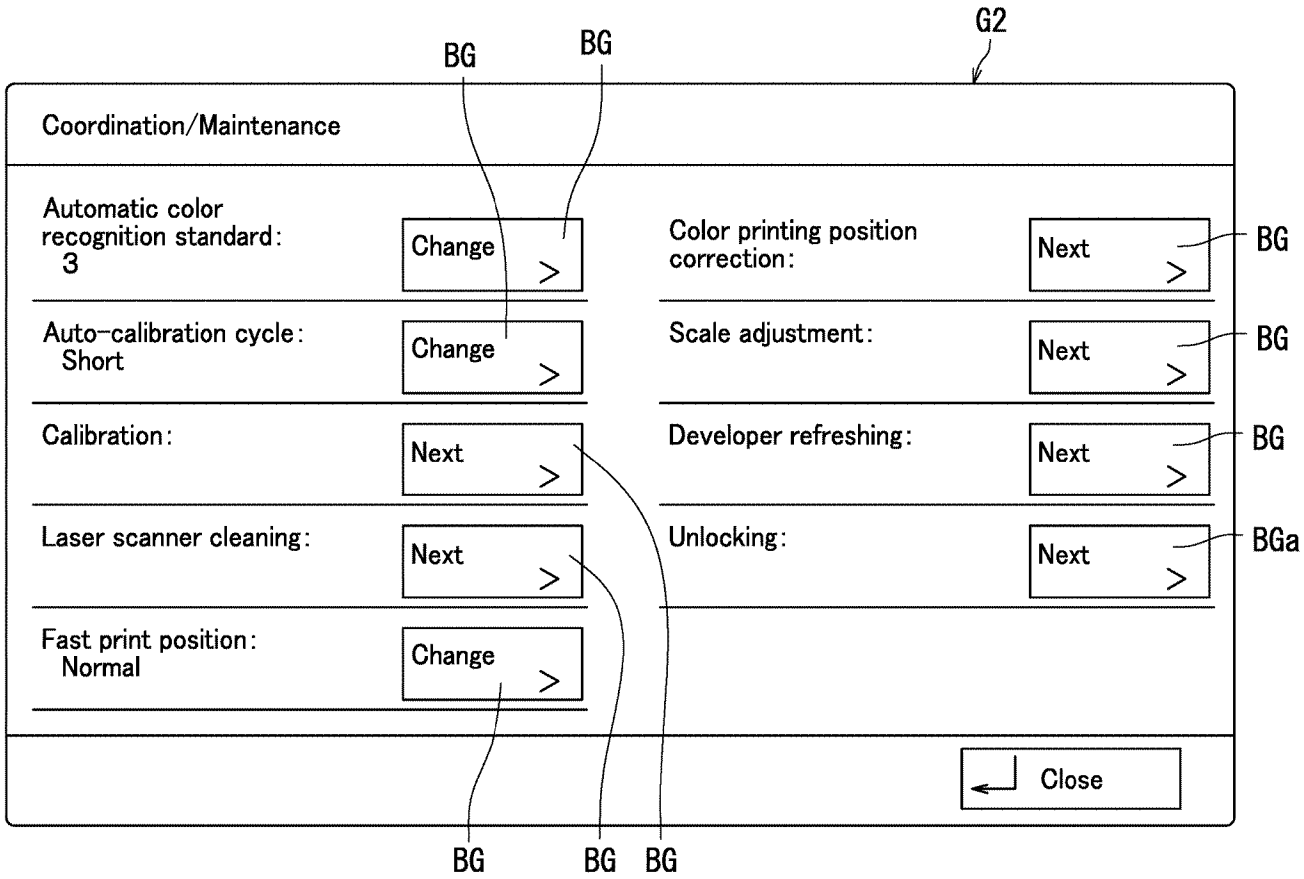
FIG. 5 illustrates another example of the operation input screen.
Figure 6:
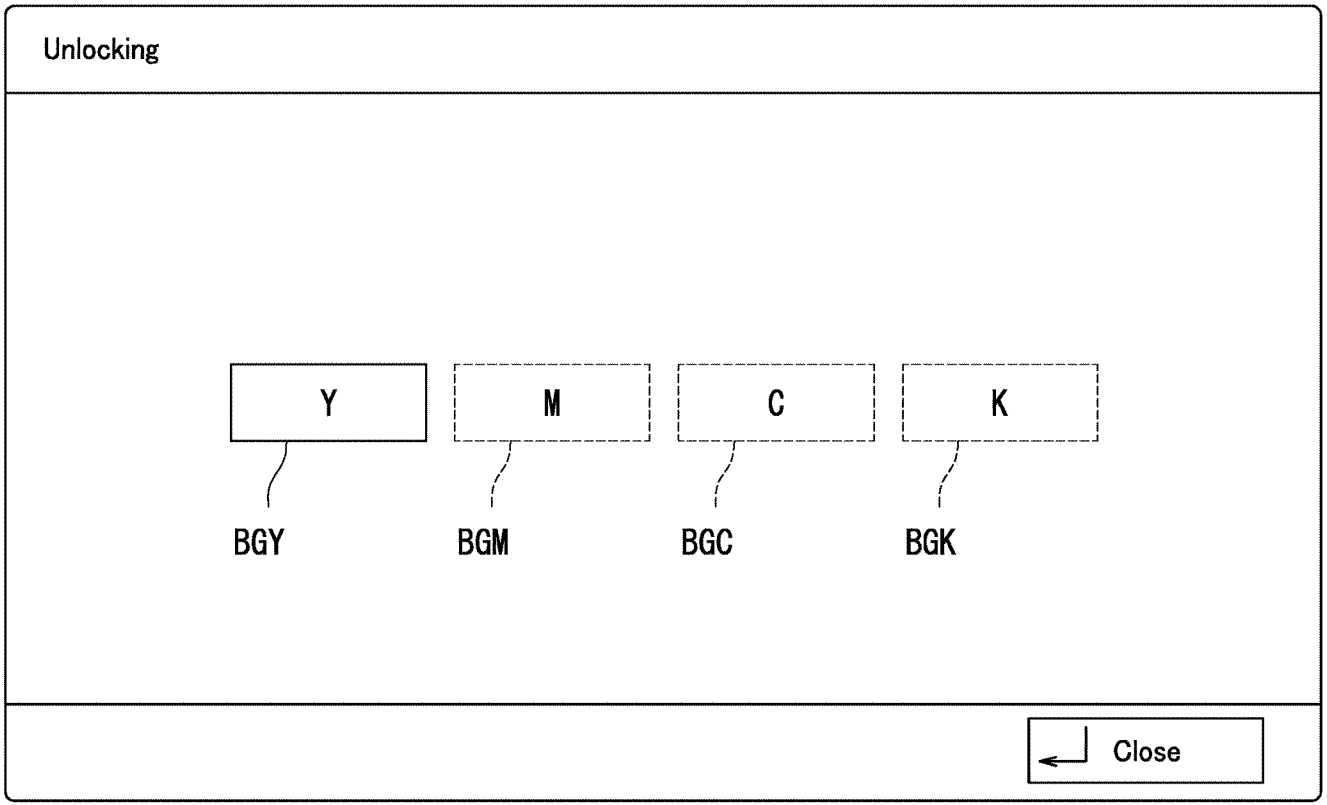
FIG. 6 illustrates still another example of the operation input screen.

Examples of the operation input screen will be described with reference to FIGS. 3-6. FIG. 4 illustrates an example of the operation input screen. The operation input screen illustrated in FIG. 4 is displayed on the display section 19*a* when detection results of all of the toner sensors 17 are greater than the amount range of remaining toner in the nearly empty state. FIGS. 5 and 6 each illustrate another example of the operation input screen. The respective operation input screens illustrated in FIGS. 5 and 6 are displayed on the display section 19*a* when a detection result of at least one of the toner sensors 17 falls in the amount range of remaining toner in the nearly empty state.

When the determination section 201 determines that detection results of all of the toner sensors 17 are greater than the amount range of remaining toner in the nearly empty state, the display control section 202 causes the display section 19*a* to display an operation input screen G1 as illustrated in FIG. 4.

The operation input screen G1 is for example an operation input screen for coordination and maintenance. Various button images BG are displayed in the operation input screen G1. The button images BG are for coordination of settings of various functions of the image forming apparatus 1 or for execution of maintenance of various functions.

Examples of the settings of the functions includes "automatic color recognition standard", "auto-calibration cycle", "first print position", and "scale adjustment". Examples of maintenance of the functions include "calibration", "laser scanner cleaning", "color printing position correction", and "developer refreshing".

When the determination section 201 determines that a detection result of at least one of the toner sensors 17 falls in the amount range of remaining toner in the nearly empty state, the display control section 202 causes the display section 19*a* to display for example an operation input screen G2 for receiving the unlocking operation (first operation input screen), as illustrated in FIG. 5.

The operation input screen G2 is for receiving input of the unlocking operation for unlocking one of the toner containers 7 locked by a latch mechanism 18 corresponding to a toner sensor 17 an amount of remaining toner in which falls in the amount range of remaining toner in the nearly empty state. That is, the unlocking operation for unlocking of the toner container 7 locked by the latch mechanism 18 corresponding to the toner sensor 17 can be input through the operation panel 19 displaying the operation input screen G2. The operation input screen G2 is the operation input screen G1 to which a button image BGa is added. The button image BGa is for presenting an option to select a function of "unlocking". The function of "unlocking" is a function of unlocking any of the toner sensors 17 locked by a corresponding latch mechanism 18 in response to the unlocking operation input to the operation panel 19.

When the button image BGa in the operation input screen G2 is touched (that is, when the operation input section 19*b* detects a touch point on the button image BGa), the display control section 202 causes the display section 19*a* to display for example an operation input screen G3 for receiving the unlocking operation (second operation input screen), as illustrated in FIG. 6. The operation input screen G3 is for presenting selection options as to which of the latch mechanisms 18 is to unlock a corresponding toner container 7.

For example, unlock button images are displayed in the operation input screen G3. The unlock button images are for receiving input for unlocking any of the toner containers 7 locked by the respective latch mechanisms 18 each corresponding to one of the toner sensors 17.

Specifically, a plurality of unlock button images BGY, BGM, BGC, and BGK are displayed in the operation input screen G3. The unlock button images BGY, BGM, BGC, and BGK each are for unlocking a corresponding one of the toner containers 7Y, 7M, 7C, and 7K locked by the respective latch mechanisms 18.

Among the unlock button images BGY, BGM, BGC, and BGK in FIG. 6, the unlock button image BGY corresponding to the toner sensor 17Y is indicated in a usual manner (that is, in a bold color) and the other unlock button images BGM, BGC, and BGK are displayed in a unique manner (that is, in a pale color). The unlock button image BGY is allowed to be selected by a touch operation, while the other unlock button images BGM, BGC, and BGK are not allowed to be selected by a touch operation.

When the unlock button image BGY in the operation input screen G3 is touched (that is, when the operation input section 19*b* detects a touch point on the unlock button image BGY), the locking control section 203 causes the latch mechanism 18Y corresponding to the unlock button image BGY to unlock the corresponding toner container 7Y.

Operation of the image forming apparatus 1 will now be described with reference to FIGS. 7A to 7F. FIGS. 7A to 7F each illustrate an example of the operation of the image forming apparatus 1. Bar graphs Y, M, C, and K in each of FIGS. 7A to 7F indicate amounts of toners remaining in the toner containers 7Y, 7M, 7C, and 7K, respectively.

Figure 7A:
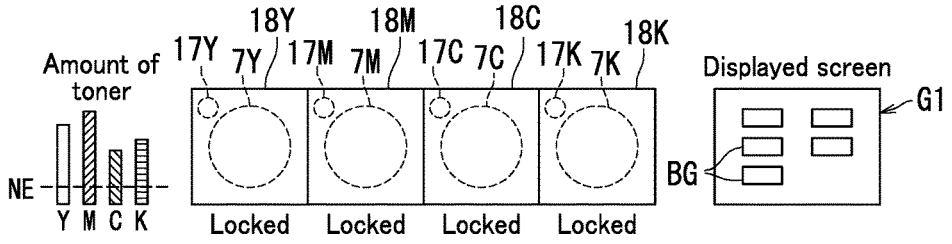
FIGS. 7A-7F each illustrate an example of operation of the image forming apparatus according to the embodiment.

In a situation of toners remaining as indicated in FIG. 7A, the amounts of the toners remaining in the respective toner containers 7Y, 7M, 7C, and 7K are all greater than the upper limit value NE of the amount range of remaining toner in the nearly empty state. In the situation as above, the determination section 201 determines that detection results of the toner sensors 17Y, 17M, 17C, and 17K are all greater than the amount range of remaining toner in the nearly empty state.

On the basis of the detection results, the locking control section 203 controls the latch mechanisms 18Y, 18M, 18C, and 18K such that all of the toner containers 7Y, 7M, 7C, and 7K are locked in the casing 4. In the above configuration, none of the toner containers 7Y, 7M, 7C, and 7K are allowed to be replaced by a new toner container.

Furthermore, the display control section 202 causes the display section 19*a* to display the operation input screen G1 (see FIG. 4). When the toner Y is used then, the amounts of toners remaining in the respective toner containers 7 are as indicated in FIG. 7B.

Figure 7B:
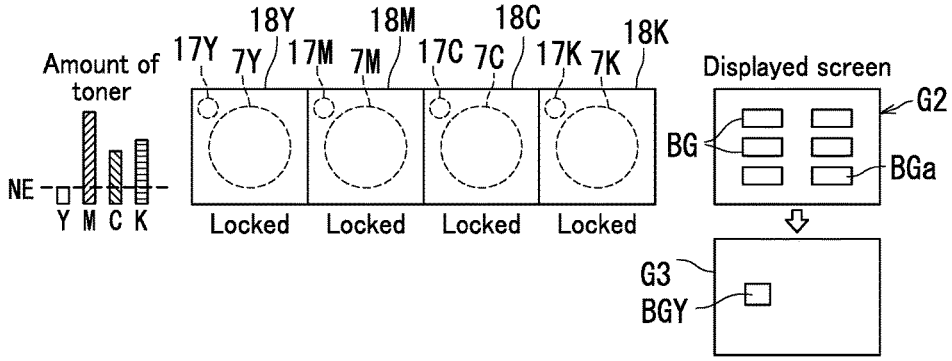

As indicated in FIG. 7B, the amount of toner remaining in the toner container 7Y is equal to the upper limit value NE of the amount range of remaining toner in the nearly empty state. In a situation as above, the determination section 201 determines that a detection result of the toner sensor 17Y falls in the amount range of remaining toner in the nearly empty state. On the basis of the detection result, the display control section 202 causes the display section 19*a* to display the operation input screen G2 (see FIG. 5). The button image BGa for presenting option to select "unlocking" is displayed in the operation input screen G2.

Note that the locking control section 203 maintains control on the latch mechanisms 18Y, 18M, 18C, and 18K such that all of the toner containers 7Y, 7M, 7C, and 7K are locked in the casing 4.

When the button image BGa in the operation input screen G2 is touched, the display control section 202 causes the display section 19*a* to switch the currently displayed operation input screen G2 to the operation input screen G3 (see FIG. 6). The unlock button image BGY is displayed in the usual manner in the operation input screen G3. The unlock button image BGY is for receiving input of the unlocking operation for unlocking the toner container 7Y locked by the latch mechanism 18Y.

Figure 7C:
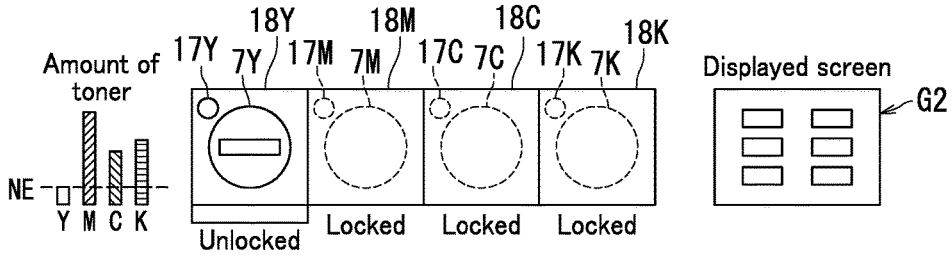

When the unlock button image BGY in the operation input screen G3 is touched, the locking control section 203 controls the latch mechanism 18Y to unlock the toner container 7Y as illustrated in FIG. 7C. Unlocking the toner container 7Y locked by the latch mechanism 18Y allows replacement of the toner container 7Y by a new toner container. Note that the other toner containers 7M, 7C, and 7K remain locked so as not to be allowed to be replaced by a new toner container. The display control section 202 causes the display section 19*a* to switch the currently displayed operation input screen G3 to the operation input screen G2.

Figure 7D:
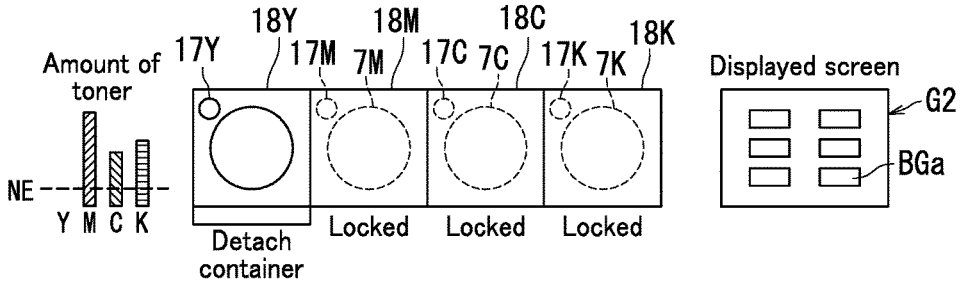
Figure 7E:
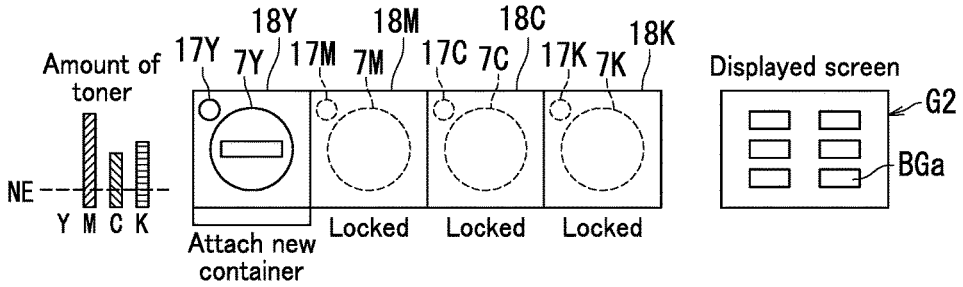
Figure 7F:
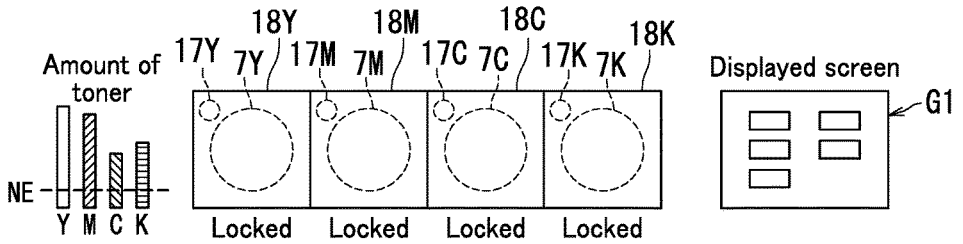

Thereafter, the toner container 7Y is detached from the casing 4, as illustrates in FIG. 7D. Then, as illustrated in FIG. 7E, a new toner container 7Y is attached to the casing 4 as the user desires. That is, the toner container 7Y is replaced by a new toner container 7Y.

Replacement of the toner container 7Y by a new toner container 7Y results in that the amount of toner in the new toner container 7Y is greater than the upper limit value NE of the amount range of remaining toner in the nearly empty state. As such, the respective amounts of the toner containers 7Y, 7M, 7C, and 7K are all greater than the amount range of remaining toner in the nearly empty state. In a situation as above, the determination section 201 determines that the detection results of the toner sensors 17Y, 17M, 17C, and 17K are all greater than the amount range of remaining toner in the nearly empty state in a manner similar to that in the situation illustrated in FIG. 7A.

On the basis of the detection results, the locking control section 203 controls the latch mechanisms 18Y, 18M, 18C, and 18K such that all of the toner containers 7Y, 7M, 7C, and 7K are locked in the casing 4. The display control section 202 causes the display section 19*a* to switch the currently displayed operation input screen G2 to the operation input screen G1. That is, the button image BGa is not displayed on the display section 19*a*. In association therewith, the unlocking operation for unlocking any of the toner containers 7Y, 7M, 7C, and 7K locked by the respective latch mechanisms 18Y, 18M, 18C, and 18K cannot be input. As a result, none of the toner containers 7Y, 7M, 7C, and 7K are allowed to be replaced by a new toner container.

As described above, replacement of each of the toner containers 7Y, 7M, 7C, and 7K in which much toner remains (for example, the amount of remaining toner is greater than the amount range of remaining toner in the nearly empty state) is prevented and any of the toner containers 7Y, 7M, 7C, and 7K the amount of toner in which falls in the amount range of remaining toner in the nearly empty state is allowed to be replaced as necessary.

Through the above, an embodiment of the present disclosure has been explained with reference to the drawings (FIGS. 1-7F). However, the present disclosure is not limited to the above-described embodiment and can be practiced in various ways within the scope without departing from the essence of the present disclosure. The drawings schematically illustrate elements of configuration in order to facilitate understanding. Properties of the elements of configuration illustrated in the drawings such as thickness, length, and quantity may differ from reality in order to aid preparation of the drawings. Materials, shapes, dimensions, etc. of the elements of configuration given in the above embodiment are merely examples that do not impart any particular limitations and may be altered in various ways, so long as such alterations do not substantially deviate from the configuration of the present disclosure.

What is claimed is:

1. An image forming apparatus comprising:

an apparatus main body;

a toner container attached to the apparatus main body in a detachable manner;

a latch mechanism configured to lock the toner container in the apparatus main body to prevent the toner container from being detached from the apparatus main body;

a toner sensor configured to detect an amount of toner remaining in the toner container;

a determination section configured to determine whether or not a detection result of the toner sensor falls in an amount range of remaining toner in a nearly empty state;

an operation input section configured to receive an unlocking operation for unlocking the toner container in the apparatus main body locked by the latch mechanism;

a locking control section configured to control the latch mechanism; and a display section, wherein when the determination section determines that a detection result of the toner sensor is greater than the amount range of remaining toner in the nearly empty state, the locking control section controls the latch mechanism to lock the toner container in the apparatus main body, when the determination section determines that a detection result of the toner sensor falls in the amount range of remaining toner in the nearly empty state, the locking control section controls the latch mechanism to unlock the toner container in the apparatus main body in response to the unlocking operation input through the operation input section, the operation input section detects a touch point in the display section, when the determination section determines that a detection result of the toner sensor falls in the amount range of remaining toner in the nearly empty state, the display section displays a first operation input screen, the first operation input screen includes a first button image for presenting an option to select a function to unlock the toner container locked by the latch mechanism, a second button image for coordination of setting of the function of the image forming apparatus, and a third button image for execution of maintenance of the function of the image forming apparatus, the setting of the function is automatic color recognition standard or auto-calibration cycle, the maintenance of the function includes calibration, laser scanner cleaning, color printing position correction, and developer refreshing, when the operation input section detects a touch point on the first button image, the display section displays a second operation input screen, the second operation input screen includes an unlock button image for unlocking the toner container locked by the latch mechanism corresponding to the toner sensor for which the determination section determines that the amount of toner in the toner container falls in the amount range of remaining toner in the nearly empty state, and when the operation input section detects a touch point on the unlock button image, the locking control section unlocks the toner container locked by the latch mechanism corresponding to the unlock button image.

2. The image forming apparatus according to claim 1, further comprising:

a plurality of the toner containers;

a plurality of the latch mechanisms each corresponding to one of the plurality of toner containers; and a plurality of the toner sensors each corresponding to one of the plurality of toner containers, wherein when the determination section determines that a detection result of at least one of the toner sensors falls in the amount range of remaining toner in the nearly empty state, the operation input section is allowed to receive input of the unlocking operation for unlocking a toner container locked by one of the latch mechanisms that corresponds to the at least one toner sensor.

3. The image forming apparatus according to claim 1, wherein the determination section determines that a detection result of the toner sensor falls in the amount range of remaining toner in the nearly empty state when an amount of toner remaining in the toner container is equal to an upper limit value, and determines that a detection result of the toner sensor is greater than the amount range of remaining toner in the nearly empty state when an amount of toner remaining in the toner container is greater than the upper limit value, and the upper limit value indicates an amount of toner remaining in the toner container in a situation in which the toner container is almost empty.

4. The image forming apparatus according to claim 1, wherein the apparatus main body has an opening located in a side surface portion of the apparatus main body, the latch mechanism includes a latching cover supported on the apparatus main body pivotally about a pivot axis line; and a drive section including a drive bar, the pivotal axis line is located at a lower part of the latching cover and perpendicular to a vertical direction, the drive section pivots the latching cover in a closing direction for closing the opening by pushing the drive bar away from the drive section, and pivots the latching cover in an opening direction for opening the opening by pulling the drive bar toward the drive section, and the latching cover locks the toner container in the apparatus main body by closing the opening, and unlocks the toner container in the apparatus main body by opening the opening.

5. The image forming apparatus according to claim 1, further comprising a display control section, wherein when the toner container locked by the latch mechanism is unlocked, the display control section switches a screen displayed on the display section from the second operation input screen to the first operation input screen, when the determination section determines after the toner container is unlocked that a detection result of the toner sensor is greater than the amount range of remaining toner in the nearly empty state, the display control section switches the screen displayed on the display section from the first operation input screen to a third operation input screen, the third operation input screen includes the second button image, and the first button is not displayed in the third operation input screen.

* * * * *